US008064627B2

(12) United States Patent
Maeshiba

(10) Patent No.: US 8,064,627 B2
(45) Date of Patent: Nov. 22, 2011

(54) ACOUSTIC SYSTEM

(76) Inventor: David Maeshiba, Chicago, IL (US)

( * ) Notice: Subject to any disclaimer, the term of this patent is extended or adjusted under 35 U.S.C. 154(b) by 579 days.

(21) Appl. No.: 12/255,167

(22) Filed: Oct. 21, 2008

(65) Prior Publication Data

US 2009/0103758 A1 Apr. 23, 2009

Related U.S. Application Data

(60) Provisional application No. 60/981,568, filed on Oct. 22, 2007.

(51) Int. Cl.
*H04R 1/02* (2006.01)

(52) U.S. Cl. ..... 381/349; 381/345

(58) Field of Classification Search ..... 381/345, 381/349

See application file for complete search history.

(56) References Cited

U.S. PATENT DOCUMENTS

| | | | |
|---|---|---|---|
| D75,617 | S | 6/1928 | Faison |
| 1,750,900 | A | 3/1930 | Minton et al. |
| 1,785,377 | A | 12/1930 | De Forest et al. |
| 1,836,075 | A | 12/1931 | Hutchison, Jr. |
| 1,866,913 | A | 7/1932 | Stenger |
| 1,888,769 | A | 11/1932 | Muench |
| 1,890,719 | A | 12/1932 | Busch |
| 1,930,915 | A | 10/1933 | Wente |
| 2,031,500 | A | 2/1936 | Olney |
| 2,058,132 | A | 10/1936 | Cirelli |
| 2,224,919 | A | 12/1940 | Olson |
| 2,277,525 | A | 3/1942 | Mercurius |
| 2,373,692 | A | 4/1945 | Klipsch |
| 2,646,852 | A | 7/1953 | Forrester |
| 2,731,101 | A | 1/1956 | Klipsch |
| 2,751,997 | A | 7/1956 | Gately, Jr. |
| 2,801,703 | A | 8/1957 | Martin |
| 2,810,448 | A | 10/1957 | Van Dijck |
| 2,812,033 | A | 11/1957 | Young |
| 2,816,619 | A | 12/1957 | Karlson |
| 2,822,884 | A | 2/1958 | Simpson |
| 2,825,419 | A | 3/1958 | Stephens, Jr. |
| 2,858,377 | A | 10/1958 | Levy |
| 2,866,513 | A | 12/1958 | White |
| 2,871,972 | A | 2/1959 | Glassey |
| 2,880,817 | A | 4/1959 | Burns et al. |
| 2,975,852 | A | 3/1961 | Chave |
| 2,986,229 | A | 7/1961 | Perkins, Jr. |
| 3,122,215 | A | 2/1964 | Sutton |
| 3,142,353 | A | 7/1964 | Todisco |
| 3,276,538 | A | 10/1966 | Guyton et al. |

(Continued)

OTHER PUBLICATIONS

Patent Cooperation Treaty, PCT/US2008/080619, Advance E-Mail, PCT Notification Concerning Transmittal of International Preliminary Report on Patentability (Chapter 1 of the Patent Cooperation Treaty), from the International Bureau, Date of Mailing: May 6, 2010.

(Continued)

*Primary Examiner* — Ramon Barrera
(74) *Attorney, Agent, or Firm* — Eugene M. Cummings, P.C.

(57) ABSTRACT

An acoustic system is described for accurately reproducing sound. The acoustic system generally includes driver which produces a plurality of higher frequency pressure waves at larger amplitudes and produces lower frequency pressure waves at smaller amplitudes. A passage is provided which serves as an amplifier and resonator for the lower frequency pressure waves. Accordingly, the system accurately reproduces a large range of higher and lower frequency sounds.

16 Claims, 5 Drawing Sheets

U.S. PATENT DOCUMENTS

| | | | |
|---|---|---|---|
| 3,327,808 | A | 6/1967 | Shaper |
| 3,486,578 | A | 12/1969 | Albarino |
| 3,529,691 | A | 9/1970 | Wesemann |
| 3,666,041 | A | 5/1972 | Engelhardt |
| 3,687,221 | A | 8/1972 | Bonnard |
| 3,917,024 | A | 11/1975 | Kaiser, Jr. |
| 3,923,124 | A | 12/1975 | Hancock |
| 3,993,162 | A | 11/1976 | Juuti |
| 4,071,112 | A | 1/1978 | Keele, Jr. |
| 4,126,204 | A | 11/1978 | Ogi et al. |
| 4,138,594 | A | 2/1979 | Klipsch |
| 4,164,988 | A | 8/1979 | Virva |
| 4,168,761 | A | 9/1979 | Pappanikolaou |
| 4,173,266 | A | 11/1979 | Pizer et al. |
| 4,210,223 | A | 7/1980 | Gillum et al. |
| 4,237,340 | A | 12/1980 | Klipsch |
| 4,296,280 | A | 10/1981 | Richie |
| 4,308,932 | A | 1/1982 | Keele, Jr. |
| 4,313,032 | A | 1/1982 | Thomas et al. |
| 4,324,313 | A | 4/1982 | Nakagawa |
| 4,387,786 | A | 6/1983 | Klipsch et al. |
| 4,398,619 | A | 8/1983 | Daniel |
| 4,482,026 | A | 11/1984 | Stehlin, Jr. |
| 4,524,846 | A | 6/1985 | Whitby |
| 4,553,628 | A | 11/1985 | Nakamura |
| 4,580,655 | A | 4/1986 | Keele, Jr. |
| 4,592,444 | A | 6/1986 | Perrigo |
| 4,628,528 | A | 12/1986 | Bose et al. |
| 4,655,315 | A | 4/1987 | Saville |
| 4,760,601 | A | 7/1988 | Pappanikolaou |
| 4,790,408 | A | 12/1988 | Adair |
| 4,807,293 | A | 2/1989 | Weckler |
| 4,853,964 | A | 8/1989 | Weckler |
| 4,930,596 | A | 6/1990 | Saike et al. |
| 4,942,939 | A | 7/1990 | Harrison |
| 4,969,196 | A | 11/1990 | Nakamura |
| 4,982,436 | A | 1/1991 | Cowan |
| 4,987,601 | A | 1/1991 | Goto |
| 5,111,905 | A | 5/1992 | Rodgers |
| 5,131,052 | A | 7/1992 | Hill et al. |
| 5,187,333 | A | 2/1993 | Adair |
| 5,197,103 | A | 3/1993 | Hayakawa |
| 5,206,465 | A | 4/1993 | Jung |
| 5,296,656 | A | 3/1994 | Jung |
| 5,343,535 | A | 8/1994 | Marshall |
| 5,373,564 | A | 12/1994 | Spear et al. |
| 5,432,860 | A | 7/1995 | Kasajima et al. |
| 5,436,977 | A | 7/1995 | Sato |
| 5,471,019 | A | 11/1995 | Maire |
| 5,517,573 | A | 5/1996 | Polk et al. |
| 5,610,992 | A | 3/1997 | Hickman |
| 5,693,916 | A | 12/1997 | von Sprecken |
| 5,710,395 | A | 1/1998 | Wilke |
| 5,821,471 | A | 10/1998 | McCuller |
| 5,824,969 | A | 10/1998 | Takenaka |
| 5,975,236 | A | 11/1999 | Yamamoto et al. |
| 6,062,338 | A | 5/2000 | Thompson |
| 6,062,339 | A | 5/2000 | Hathaway |
| 6,078,676 | A | 6/2000 | Takenaka |
| 6,104,823 | A | 8/2000 | Tanaka |
| 6,278,789 | B1 | 8/2001 | Potter |
| 6,356,643 | B2 | 3/2002 | Yamagishi et al. |
| 6,411,721 | B1 | 6/2002 | Spindler |
| 6,425,456 | B1 | 7/2002 | George |
| 6,634,455 | B1 | 10/2003 | Yang |
| 6,636,610 | B1 | 10/2003 | Betts |
| 6,648,098 | B2 | 11/2003 | Nichols |
| 6,665,413 | B1 | 12/2003 | Domen |
| 6,700,984 | B1 | 3/2004 | Holberg et al. |
| 6,704,425 | B1 | 3/2004 | Plummer |
| 6,735,320 | B1 | 5/2004 | Gertner, Jr. |
| 6,763,117 | B2 | 7/2004 | Goldslager et al. |
| 6,771,787 | B1 | 8/2004 | Hoefler et al. |
| 6,862,360 | B2 | 3/2005 | Tsai |
| 6,931,143 | B2 | 8/2005 | Caron et al. |
| 6,973,994 | B2 | 12/2005 | Mackin et al. |
| 7,218,747 | B2 | 5/2007 | Huffman |
| 7,436,972 | B2 * | 10/2008 | Bouvier ..... 381/345 |
| 2002/0003888 | A1 | 1/2002 | Budge |
| 2005/0133298 | A1 | 6/2005 | Hasegawa |
| 2007/0092092 | A1 | 4/2007 | Kondo et al. |

OTHER PUBLICATIONS

Reader's Choice D-101S; Dec. 20, 2001; http//www.kawaguchimusen.co.jp/d-101sa.htm.

Flamingo; D-83; Dec. 13, 2001; . . . /urltrurl?Ip=ja_en &url=http%2Fwww2.nkansai.ne.jp%2Fhotel%2Fnakanou%2Fd-83.

Lowther Club of Norway—The Voight Pipe; The Voight Pipe: The world's most easy-to-build High End Loudspeaker; Aug. 19, 1996.

Minibass horn with VISA CLAY/TONE FRS 8; Bass horn loudspeaker with VISA CLAY/TONE broadband chassis FRS 8; Dec. 24, 2001; http://www.speaker-online.de/bauen/bhorn.htm.

The Hedlund Horn by Jan Hedlund; Mar. 19, 1998; http://www.vt52.com/jim/diy/hedlund/hedlund.html.

D-105 The *Nagaoka iron man person design, Conical horn type back load; Dec. 23, 2001; . . . /urltrurl?1p=ja_en &url=http%3A%2F%2Fwww2.nkansai.ne.jp%2Fnakanou%2Fd-1.

Audio craft—Pleasant craft vol. 3, Speaker box (enclosure) terminal; Mar. 3, 2007; http://64.233.179.104/translate_c?hl=en&sl=ja &u=http://www.audio-k.com/audio/craft_3.htm&prev=/sear . . . .

Sonicart loudspeaker load smoothing curves back; Hasehiro Audio Sonicart; http://64.233.179.104/translate_c?hl=en&sl=zh-TW &u=http://www.chct.com.tw/orderc.htm&prev=/search . . . .

Super Flamingo-D88 Literature.

D-101a Swan 88 by Nasao Ida.

D-108S Super Sidewinder (Literature).

D-118.2; O Make D118 from unit FE88 ES-R (Literature).

The speaker of 8 cm (Literature).

F-81 slim eight (Literature).

The speaker of 10 CM (Literature).

2 D-118.2 (Literature).

The optimal resonance pipe speaker for rear (Literature).

QS106 Rear Canon II (Literature).

As rear of [saraundo] the recommendation (Literature).

The real speaker of (4)8.5cm/10cm (Literature).

Fostex (Literature).

Drawing Sheet; Feb. 19, 2007; http://www2.nkansai.ne.jp/hotel/nakanou/Flamingo.jpg.

* cited by examiner

ACOUSTIC SYSTEM

FIELD OF THE DISCLOSURE

This application claims the benefit of U.S. Provisional Application No. 60/981,568, filed Oct. 22, 2007. The present disclosure relates generally to an acoustic system and more specifically, an acoustic system which accurately reproduces sound.

DESCRIPTION OF THE PRIOR ART

Acoustic systems generally include a loudspeaker for reproducing sound. The loudspeaker in an acoustic system may comprise a single driver or multiple drivers which convert electrical signals into sound pressure waves. More specifically, drivers generally include an actuator and a diaphragm. In response to electrical signals, the actuator oscillates the diaphragm to produce a plurality of sound pressure waves having higher and lower frequencies.

The size of the diaphragm and type of driver generally dictate the range of higher and lower frequencies that each driver may reproduce. For example, drivers having a diaphragm with a small diameter are generally able to reproduce higher frequency pressure waves at larger amplitudes. However, in general, these smaller diaphragms unaided are not able to reproduce lower frequency pressure waves at the level desired for consumer acoustic systems. Accordingly, acoustic systems which utilizing only drivers with smaller diaphragms have not traditionally been able to accurately reproduce lower frequency sounds. Conversely, in general, drivers having a relatively large diaphragm are better able to produce lower frequency pressure waves at larger amplitudes than are drivers with small diaphragms but those relatively large diaphragm drivers do not produce the higher frequencies as well as the their small diaphragm counterparts.

In view of such, some prior art acoustic systems include loudspeakers with a range of drivers for reproducing a range of higher and lower frequency pressure waves. For example, a combination of larger and smaller drivers have been integrated in an attempt to reproduce the full range of sound, e.g. higher and lower frequency sounds. In such systems, the sound emitted from each driver is focused to a point where the listener hears the reproduced sound. These systems often include cross-over circuits designed to match the frequency domain of the various drivers. Some systems also attempt to include circuitry for maintaining the time domain of the reproduced sound. These systems can become complicated and provide varying degrees of success.

Other prior art acoustic systems have utilized special enclosures for drivers alone or in conjunction with other drivers in an attempt to reproduce a larger range of higher and lower frequency sounds. For example, some systems have included back and/or front horns. Traditionally, single driver systems have had difficulty producing a full range of sounds without further augmentation. Accordingly, such systems have been augmented with other drivers, such as a separate tweeter. Again, these augmented systems will often include cross-over circuitry with the same limitations noted above. Other types of augmented systems, such as those utilizing a whizzer cone, have also existed but still have drawbacks. Thus, there still exists a need for an improved acoustic system.

Accordingly, it is an object of the present disclosure to provide an acoustic system for accurately reproducing sound.

It is another object of the present disclosure to provide an acoustic system which utilizes a single driver in combination with a specific interior passage.

This and other desired benefits of the preferred embodiments, including combinations of features thereof, of the disclosure will become apparent from the following description. It will be understood, however, that a process or arrangement could still appropriate the claimed invention without accomplishing each and every one of these desired benefits, including those gleaned from the following description. The appended claims, not these desired benefits, define the subject matter of the invention.

SUMMARY OF THE DISCLOSURE

An acoustic system is disclosed which accurately produces a coherent, naturally synthesized sound over a large range of frequencies, while providing an enjoyable listening experience over a wide range of listening positions. The system generally includes a single high efficiency full range driver and a specifically designed, sized and shaped interior passage which serves as an amplifier and as a resonator and which when combined together provide a naturally produced musically satisfying frequency range. More particularly, the high efficiency driver has an actuator and a diaphragm. The actuator, also sometimes called the driver motor or characterized by its component parts such as the voice coil, oscillates the diaphragm to produce a plurality of pressure waves comprising higher frequency pressure waves having larger amplitudes and lower frequency pressure waves having smaller amplitudes. The diaphragm is usually connected to a rigid basket or frame via a flexible suspension such as one which surrounds the outer periphery of the diaphragm. An enclosure, often called a head or compression chamber, is provided for supporting the driver. The enclosure further has an inner opening, often called a throat, such that at least some of the pressure waves produced by the driver are directed through the enclosure and out of the inner opening. The enclosure is also sized such that the pressure of the pressure waves having lower frequencies is preserved. A passage extends from the inner opening of the enclosure and terminates at an outer opening, or mouth, such that the pressure waves having lower frequencies are directed from the inner opening, through the passage, and out of the outer opening.

In another embodiment, the system generally comprises a driver which is supported by an enclosure. The driver includes an actuator and a diaphragm having an outer periphery which defines a region having a diameter of about 5.0 cm to about 6.0 cm not including the surrounding flexible suspension. Such drivers are commonly known as 8 cm or 3 inch or 3.3 inch class drivers. The actuator oscillates the diaphragm to produce a plurality of bidirectional pressure waves having a range of amplitudes and a range of higher and lower frequencies.

The enclosure has an inner opening such that some of the pressure waves produced by the driver are directed through the enclosure and out of the inner opening. The inner opening has a select cross-sectional area of greater than 0.65 to about 1.3, and more preferably about 1, times the cross-sectional area of the region defined by the outer periphery of the diaphragm such that the pressure of the pressure waves having lower frequencies is preserved.

A passage extends from the inner opening of the enclosure and terminates at an outer opening such that the pressure waves having lower frequencies are directed from the inner opening, through the passage, and out of the outer opening. The outer opening defines a cross-sectional area of about 8 to 12, and preferably about 10 times the cross-sectional area of the inner opening such that the amplitudes of the pressure waves corresponding to the lower frequencies are amplified. Preferably, the passage also continuously increases in cross-sectional area and has a length from about 1.5 meters to about 2.8 meters, and more preferably from about 2.2 to about 2.5 meters.

In another embodiment, the outer opening defines a cross-sectional area of about 8 to 12, and preferably about 10 times the cross-sectional area of the region defined by the outer periphery of the diaphragm.

In yet another embodiment, the cross-sectional area of the passage increases in a generally exponential manner or in a generally conical manner with a terminal flair. The passage may also be folded or include a plurality of turns.

In another embodiment, the diaphragm is constructed of a rigid material. For example, the diaphragm can be constructed of a material selected from the group consisting of a polymer, wood, wood fiber, grass fiber, metal, aluminum, titanium, paper, metallized paper, and combinations thereof. Preferably the driver is a low-excursion type driver and allows quick movement of the diaphragm to provide a good transient response.

Preferably the acoustic system has a base for supporting the passage and the outer opening is situated generally perpendicular to the base such that the pressure waves are directed generally perpendicular to the base or, alternatively, the outer opening is situated at a generally acute angle relative to the base.

It should be understood that the present disclosure includes a number of different aspects or features which may have utility alone and/or in combination with other aspects or features. Accordingly, this summary is not an exhaustive identification of each such aspect or feature that is now or may hereafter be claimed, but represents an overview of certain aspects of the present disclosure to assist in understanding the more detailed description that follows. The scope of the invention is not limited to the specific embodiments described below, but is set forth in the claims now or hereafter filed.

DETAILED DESCRIPTION OF THE ILLUSTRATED EMBODIMENTS

Figure 1:
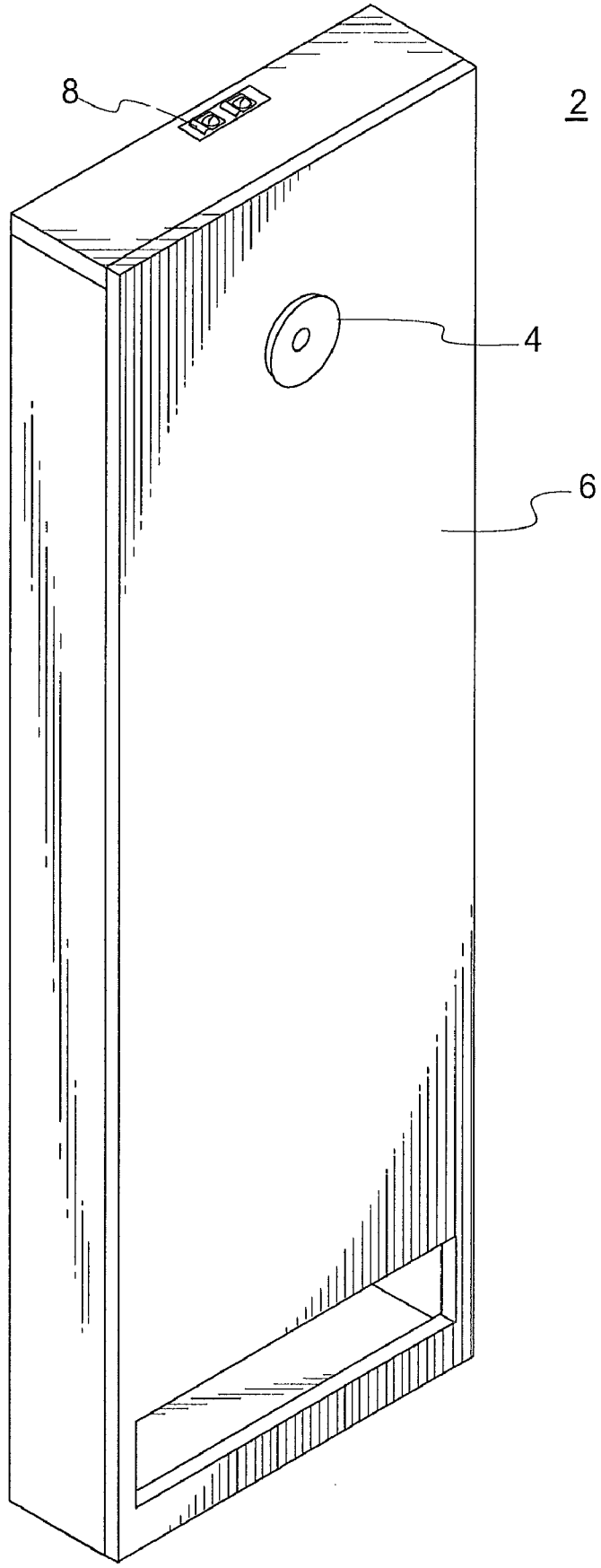
FIG. 1 is a perspective view of an acoustic system in accordance with an embodiment of the present disclosure.

FIG. 1 shows a perspective view of an acoustic system 2 in accordance with an embodiment of the present disclosure. The system generally comprises a driver 4 which is supported by a housing 6. The driver 4 generally converts electrical signals received via electrical contacts 8 into sound pressure waves.

Figure 2:
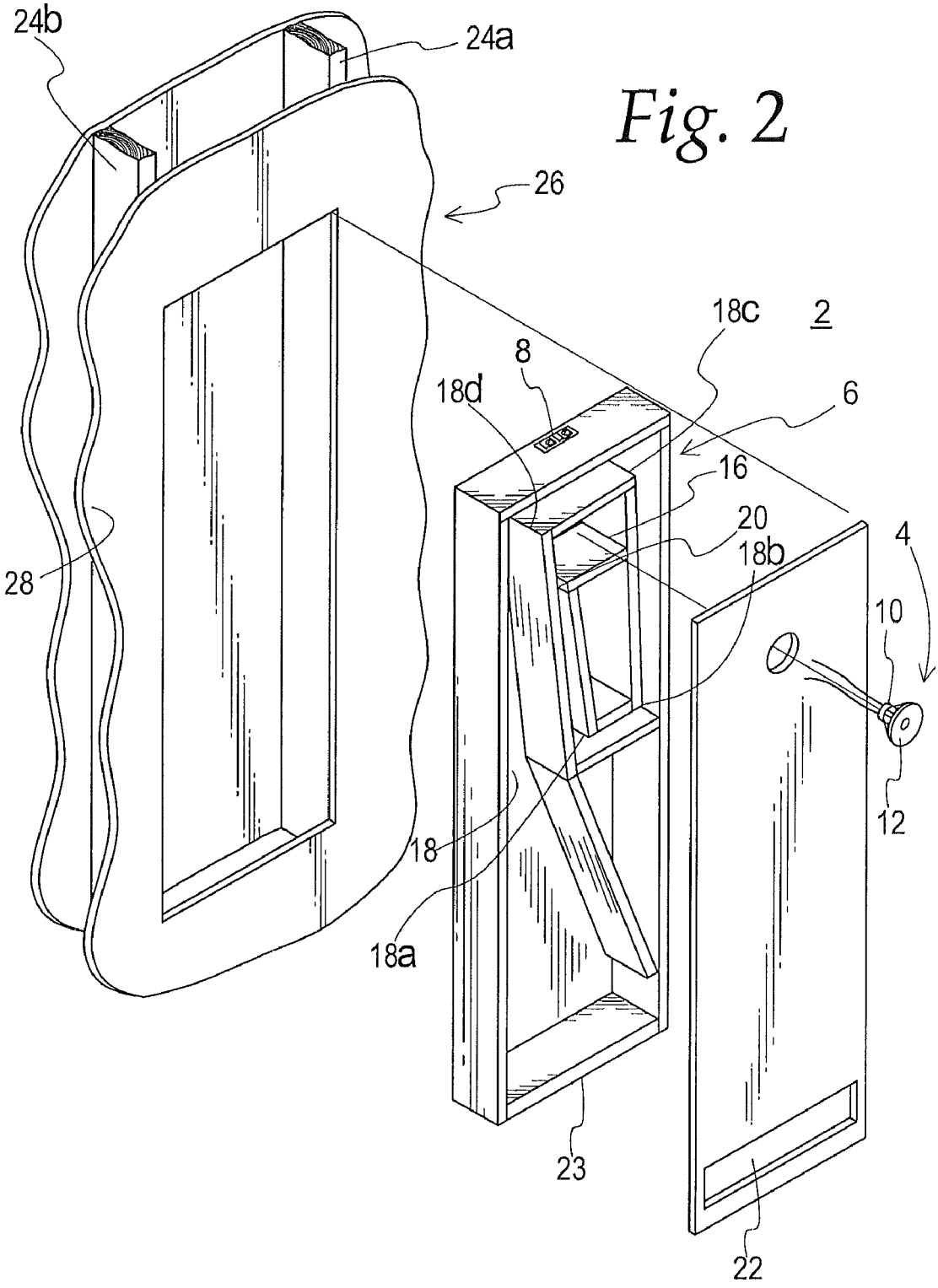
FIG. 2 is an exploded perspective view of the acoustic system of FIG. 1.

More specifically, FIG. 2 is an exploded perspective view of the acoustic system 2 of FIG. 1. The driver 4 generally comprises an actuator, also commonly called a driver motor, 10 and diaphragm 12. In response to electrical signals provided by a source (not shown), the actuator 10 oscillates the diaphragm 12 to produce a plurality of pressure waves having a range of amplitudes and a range of higher and lower frequencies. The pressure waves produced by the driver 4 are generally bidirectional, wherein higher frequency pressure waves are directed away from the housing 6 as well as into an enclosure 16, also known as a head, in the housing 6.

The diaphragm 12 has an outer periphery which defines a region having a diameter of about 5.0 cm to about 6.0 cm, preferably about 5 cm. A driver having a diaphragm with this size is generally considered a smaller driver and is often referred to as an 8 cm class or 3 inch or 3.3 inch class driver. These smaller drivers produce higher frequency pressure waves at larger amplitudes and lower frequency pressure waves at smaller amplitudes. Accordingly, the lower frequency pressure waves are amplified in accordance with further aspects of the present disclosure to acoustically reproduce lower frequency sound.

An enclosure 16, also referred to as a head or resonant chamber, and a passage 18 defined by the construction of the housing 6 are provided to amplify the pressure waves. For example, the lower frequency pressure waves produced by the driver 4 are directed into an enclosure 16. The enclosure 16 is sized such that the pressure of the lower frequency pressure waves is preserved. Preferably the enclosure 16 is sized to have a volume less than the Vas specification of driver 4. In general, Vas is one of the standard parameters that determine the frequency response of a loudspeaker driver and Vas refers to the volume of air that has the same compliance as the driver's suspension. In the acoustic systems of the present disclosure, the enclosure 16 is preferably sized to have a volume between about 0.5 and 0.9 times the Vas specification of the driver, and more preferably the volume of enclosure 16 is between about 0.65 and about 0.75 times the Vas specification of the driver. For example, in one embodiment of the present disclosure, an acoustic system using a 3" class (i.e. one with about a 5 cm diameter diaphragm) high efficiency (titanium cone with santoprene surround magnetically shielded) driver having a Vas specification of 1.22 liters may have an enclosure 16 having a volume of less than 1 liter, and more preferably have an enclosure 16 having a volume of between about 0.8 liters and about 0.95 liters.

The enclosure 16 further has an inner opening 20, sometimes referred to as a throat, sized such that the pressure of the lower frequency pressure waves is preserved and, preferably, throat 20 also acts as a filter to limit passage of the higher frequency pressure waves. In one embodiment, the inner opening 20 has a select cross-sectional area of greater than about 0.65 to about 1.3 times the cross-sectional area of the region defined by the outer periphery of the diaphragm of the driver. Preferably, the cross sectional area of inner opening 20 is about 0.85 to about 1.1, and more preferably about 0.85 to about 1.0, times the cross sectional area defined by the outer periphery of the diaphragm of the driver.

A passage 18, which acts as a back horn, extends from the inner opening 20 of the enclosure 16 to an outer opening 22, sometimes referred to as a mouth or an exit, such that the lower frequency pressure waves are directed from the inner opening 20, through the passage 18, and out of the outer opening 22, that is the waves travel from the throat through the horn and out the mouth. As such, it will be appreciated that enclosure 16, throat 20 and passage 18 are in fluid communication with each other. It will also be appreciated that except for being in fluid communication with each other enclosure 16, throat 20 and passage 18 are otherwise substantially air tight (at normal ambient pressure conditions) until reaching opening 22.

More specifically, the passage 18 and outer opening 22 are sized and shaped such that the amplitudes of the lower frequency pressure waves are amplified. For example, in one embodiment, the cross-sectional area of the outer opening 22 is sized at about 8 to about 12, and more preferably about 10, times the cross-sectional area of the inner opening 20. The passage 18 further continuously increases in cross-sectional area from the inner opening 20 to the outer opening 22. Alternatively or in conjunction with the foregoing relationship between the size of outer opening 22 and inner opening 20, the outer opening preferably defines a cross-sectional area of about 8 to about 12, and more preferably about 10, times the cross-sectional area of the region defined by the outer periphery of the diaphragm of the driver.

The passage 18 also serves as a resonator. Each pressure wave has an associated wavelength (e.g., the distance between repeating units of a propagating wave for a given frequency). The length of the passage 18 is dimensioned and shaped such that it acts not only as a horn but also as a resonator. The passage 18 is further sized and shaped such that sound emitted from the driver and from the opening 22 are perceived as a unitary sound. In speaker systems of the present invention passage 18 continuously increases in cross-sectional area from the inner opening 20 to the outer opening 22. Also, the passage 18 spans from about 1.5 meters to about 2.8 meters, preferably about 2.2 meters to about 2.5 meters in length. It will be appreciated that the length of passage 18 is measured as the length of the distance along the center line (not shown) of the path from throat 20 to opening 22.

Passage 18 can be folded to present a smaller profile for the overall speaker. As such, as shown herein, the passage 18 includes a plurality of turns. For example, as shown in FIG. 2, passage 18 turns about 90 degrees at 18*a*, about 90 degrees at 18*b*, about 90 degrees at 18*c*, and about 90 degrees at 18*d*.

In another embodiment, the passage 18 may be sized and shaped such that its cross-sectional area increases in a generally exponential manner or a generally conical manner with a terminal flair.

Preferably, as shown in FIG. 2, the acoustic system has a base 23 for supporting the passage and the outer opening 22 is situated generally perpendicular to the base such that the pressure waves are directed generally perpendicular to the base or, alternatively (not shown), the outer opening is situated at a generally acute angle relative to the base.

As shown in FIG. 2, the acoustic system 2 is sized such that it may be fitted and installed between the studs 24*a*, 24*b* of a wall 26. The acoustic system 2 may further be installed behind dry wall 28, wherein after installation, only the outer opening 22 and the driver 4 are exposed. Acoustic systems of the present invention produce relatively little overall vibration and require relatively low power usage, e.g. acoustic systems of the present invention typically can be driven by 5 watts or less of power.

The passage 18 is shown as a single passage with a single outer opening 22. While not shown passage 18 and or opening 22 can be split into sections. For example, passage 18 can be bifurcated and lead to a bifurcated opening. In such an arrangement the surface areas of the openings would in the aggregate provide the same cross-sectional relationship to the surface area of inner opening 20 as that of a single opening. In other words the aggregate cross sectional area of the bifurcated openings would be about 8 to about 12, and more preferably about 10, times the cross-sectional area of the inner opening 20.

It is to be noted that the housing 6 may be constructed of any generally rigid material or otherwise acoustically suitable material. For example, the housing 6 may be constructed of wood, metal, a polymer, like materials and combinations thereof. Likewise, the walls defining the enclosure 16 and the passage 18 may also be constructed of any generally rigid material or otherwise acoustically suitable material.

It is also to be noted that the driver 4 may be constructed of a rigid material. The diaphragm 12 of the driver may be constructed of any acoustically suitable material (e.g., a polymer, wood, wood fiber, grass fiber, metal, aluminum, paper, metallized paper, and combinations thereof). While driver 4 is adapted to produce higher frequency pressure waves at generally larger amplitudes it is also a full range driver compared to drivers designed for a specific narrow frequency range. As discussed herein, such drivers preferably are smaller drivers (e.g., an 8 cm class driver, also sometime referred to as a 3 inch or 3.3 inch class driver). This class of drivers is commercially available. For example, suppliers of 8 cm/3 inch class drivers include Visaton, Aura Sound, Fostex and Tang Band. Preferably driver 4 is a low-excursion type driver. Drivers providing good transient response, such as those having a diaphragm constructed of titanium, are especially preferred.

Figure 3:
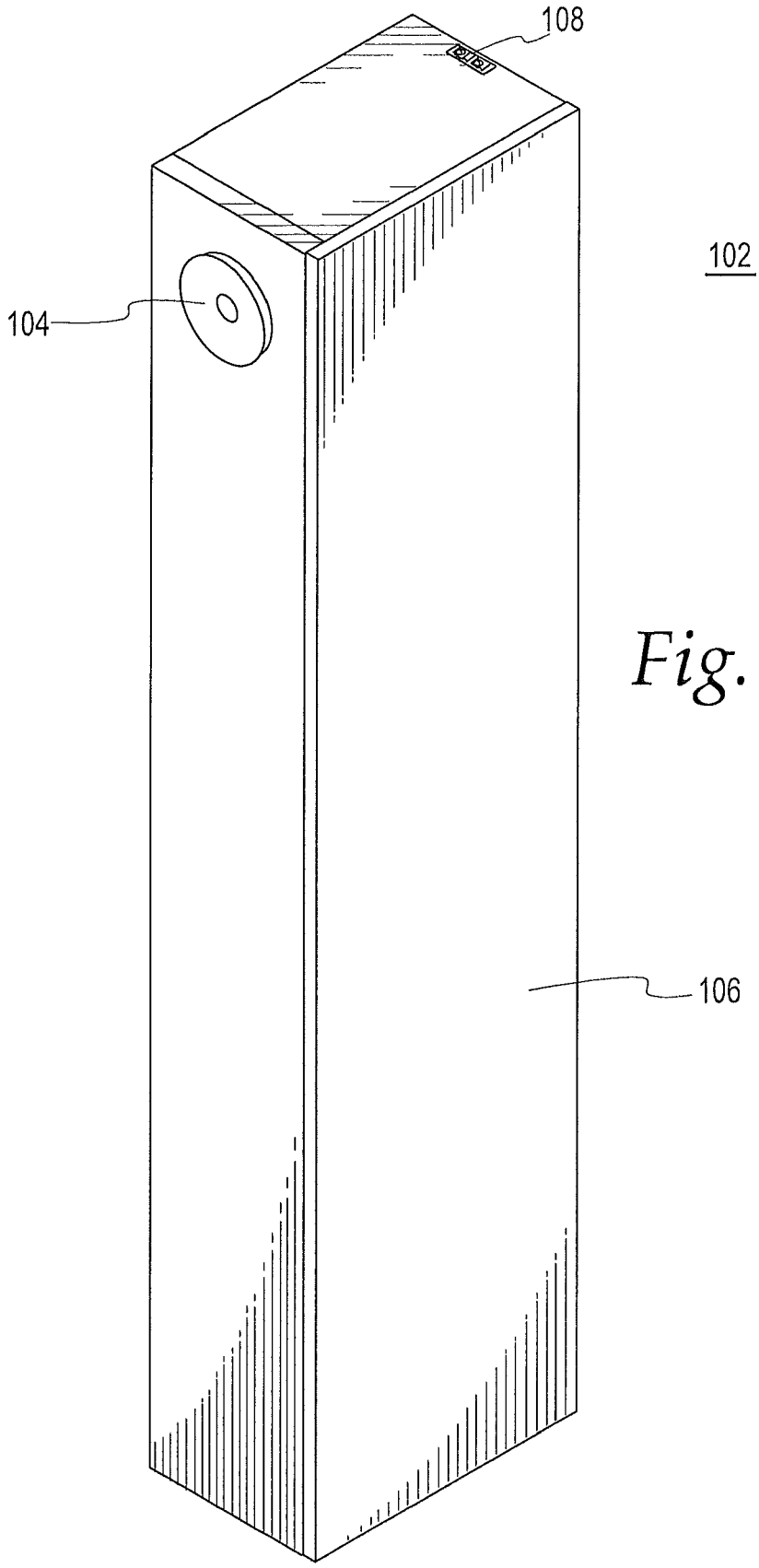
FIG. 3 is a perspective view of an acoustic system in accordance with another embodiment of the present disclosure.

FIG. 3 shows a perspective view of an acoustic system 102 in accordance with another embodiment of the present invention. The system generally comprises a driver 104 which is supported by a housing 106. The driver 104 generally converts electrical signals received via electrical contacts 108 into sound pressure waves.

Figure 4:
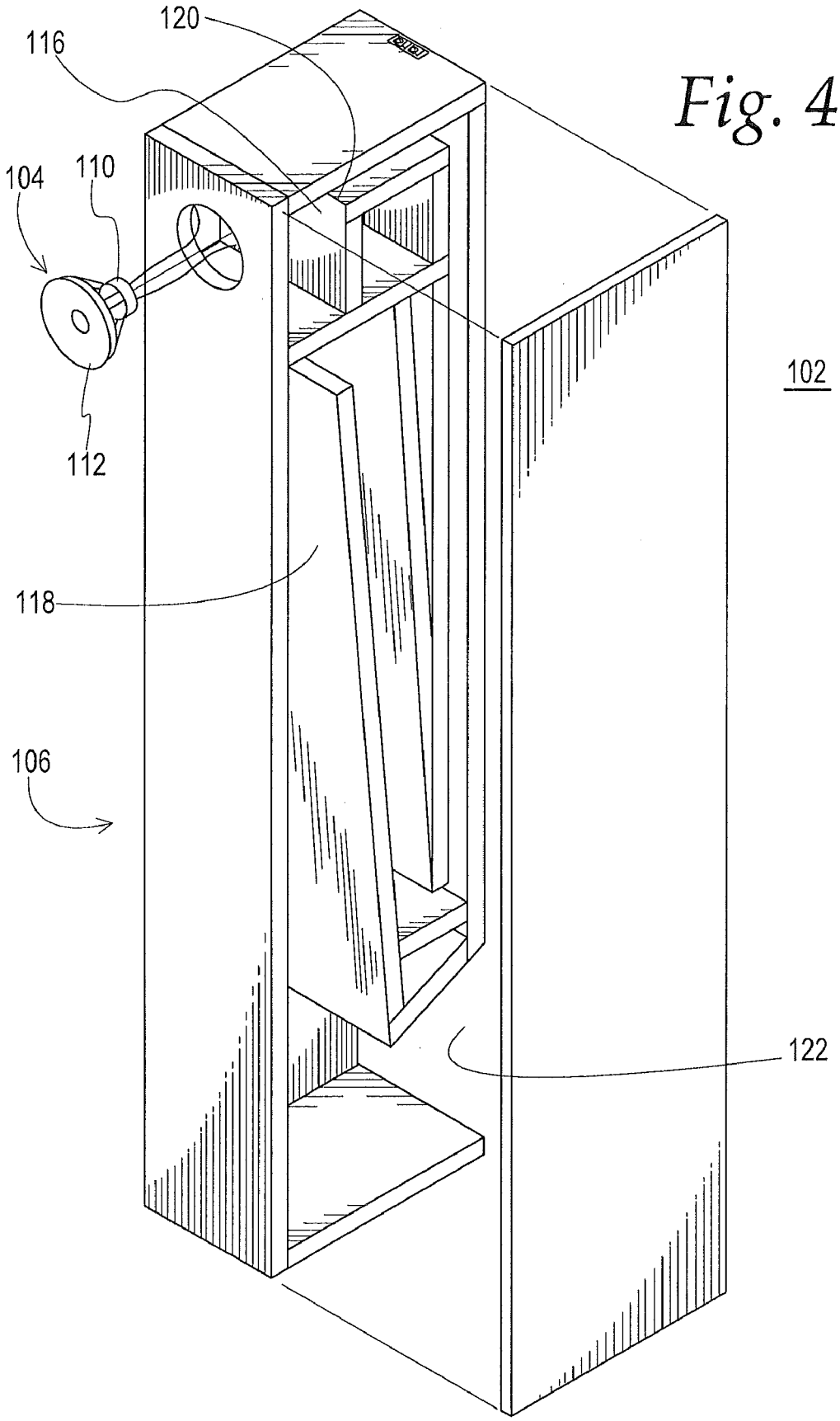
FIG. 4 is an exploded perspective view of the acoustic system of FIG. 3; and, FIG. 5 is an exploded perspective view of an acoustic system in accordance with another embodiment of the present disclosure.

More specifically, FIG. 4 is an exploded perspective view of the acoustic system 102 of FIG. 3. The driver 104 generally comprises an actuator 110 and diaphragm 112. In response to electrical signals provided by a source (not shown), the actuator 110 oscillates the diaphragm 112 to produce a plurality of pressure waves having a range of amplitudes and a range of higher and lower frequencies like the driver 4 as described with respect to the embodiments shown in FIGS. 1 and 2. The driver 104 produces pressure waves which are directed away from the housing 106 and into an enclosure 116 in the housing 106.

The diaphragm 112 has an outer periphery which defines a region having a diameter of about 5.0 cm to about 6.0 cm, preferably about 5 cm. An enclosure 116 and passage 118 defined by the construction of the housing 106 provide amplification of the lower frequency pressure waves and enhancement of the resonance associated therewith.

More specifically, the lower frequency pressure waves produced by the driver 104 are directed into an enclosure 116. The enclosure 116 is sized such that the pressure of the lower frequency pressure waves is preserved. Similar to the discussion of the acoustic system shown in FIGS. 1 and 2. Preferably the enclosure 116 is sized to have a volume less than the Vas specification of driver 104. The enclosure 116 is preferably sized to have a volume between about 0.5 and 0.9 time the Vas specification of the driver, and more preferably the volume of enclosure 116 is between about 0.65 and about 0.75 time the Vas specification of the driver. For example, in one embodiment of the present disclosure, an acoustic system using a 3" class high efficiency (titanium cone with santoprene surround magnetically shielded) driver having a Vas specification of 1.22 liters may have an enclosure 116 having a volume of less than 1 liter, and more preferably have an enclosure 116 having a volume of between about 0.8 liters and about 0.92 liters.

The enclosure 116 further has an inner opening 120 sized such that the pressure of the lower frequency pressure waves is preserved and sized to permit the inner opening to also act as a filter to limit passage of the high frequency pressure waves. In one embodiment, the inner opening 120 has a select cross-sectional area of greater than about 0.65 to about 1.3 times the cross-sectional area of the region defined by the outer periphery of the diaphragm of the driver. Preferably, the cross sectional area of inner opening 120 is about 0.85 to about 1.1, and more preferably about 0.85 to about 1.0, times the cross sectional area defined by the outer periphery of the diaphragm of the driver.

A passage 118 extends from the inner opening 120 of the enclosure 116 an outer opening 122 such that the lower frequency pressure waves are directed from the inner opening 120, through the passage 118, and out of the outer opening 122.

More specifically, the passage 118 and outer opening 122 are sized and shaped such that the amplitudes of the lower frequency pressure waves are amplified. In that regard, passage 118 acts as a back horn. For example, in one embodiment, the cross-sectional area of the outer opening 122 is sized at about 8-12, and preferably about 10, times the cross-sectional area of the inner opening 120. Preferably, the cross sectional area of a substantial length of passage 118 continuously increases from the inner opening 120 to the outer opening 122. More preferably, the passage 118 continuously increases in cross-sectional area along its entire length from the inner opening 120 to the outer opening 122.

The passage 118 also serves as a resonator. Each pressure wave has an associated wavelength (e.g., the distance between repeating units of a propagating wave for a given frequency). The length of the passage 118 is dimensioned and shaped such that it acts not only as a horn but also as a resonator. The passage 118 is further sized and shaped such that sound emitted from the driver and from the opening 22 are perceived as a unitary sound. In speaker systems of the present invention passage 118 continuously increases in cross-sectional area from the inner opening 120 to the outer opening 122. Also, the passage 118 spans from about 1.5 meters to about 2.8 meters, preferably about 2.2 meters to about 2.5 meters.

Similar to the forgoing discussion of passage 18, passage 118 can be folded to present a smaller profile for the overall speaker. As such, as shown herein, the passage 118 includes a plurality of turns which do not significantly affect the quality of the pressure wave. Also, similar to the forgoing discussion, passage 118 is shown as a single passage with a single outer opening 122. While not shown passage 118 and or opening 122 can be split into sections. For example, passage 118 can be bifurcated and lead to a bifurcated opening. In such an arrangement the surface areas of the openings would in the aggregate provide the same cross-sectional relationship to the surface area of inner opening 120 as that of a single opening. In other words the aggregate cross sectional area of the bifurcated openings would be about 8 to about 12, and more preferably about 10, times the cross-sectional area of the inner opening 120.

Figure 5:
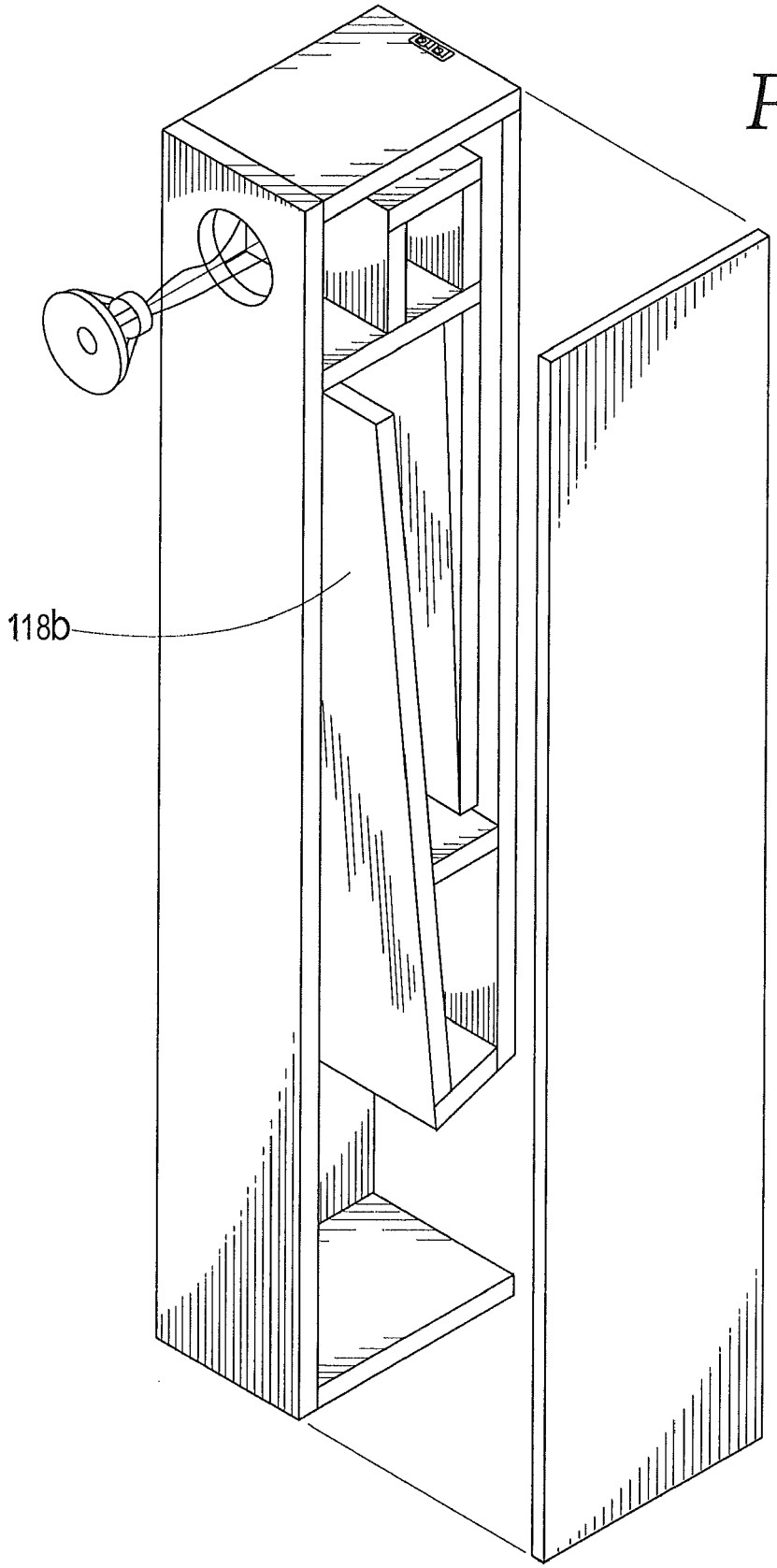

In another embodiment, as shown in FIG. 5, the passage 118*b* may be shortened to affect the amplification of the lower frequency pressure waves. It will be appreciated that acoustic systems of the present disclosure can have various exterior shapes and appearances while maintaining the disclosed relationships between the driver, head, throat, passage and opening.

The single driver systems of the present disclosure may utilize less than 5 watts and typically, less than 3 watts of power. Accordingly, these acoustic systems are easily powered by high efficiency Class D amplifiers and in combination with a source and amplifier acoustic systems as described in FIGS. 1-5 may be powered for long durations by conventional batteries including rechargeable batteries such as a rechargeable lead acid, lithium ion, or other type of rechargeable battery. Thus, the speaker systems of the present invention are particularly suited for a mobile system.

A wireless sound reproduction system may include a wireless receiver, one or more of the acoustic systems described in FIGS. 1-5, a digital to analog converter, an amplifier and power source such as a rechargeable battery. More specifically, an independent audio source may be adapted to transmit a digital signal representative of a sound to a digital wireless receiver. Coupled to the wireless receiver is a digital to analog converter which converts the transmitted digital signal to an analog electrical signal. An amplifier may be provided to amplify the converted analog signal. The present invention acoustic system as described in FIGS. 1-5 receives the electrical signal and accurately reproduces the sound.

The acoustic systems of the present disclosure can also provide an enjoyable listening experience over a wide range of listening positions utilizing a single 3" driver without utilizing a whizzer cone or phase plugs. For example, some drivers include a whizzer cone for high end dispersion. Speakers incorporating a driver with a whizzer cone tend to "beam" meaning that they will sound good in a center sweet spot but that as you go off center you will lose the full range of the reproduction. Some drivers also incorporate phase plugs to reduce the path length differences about the cone surface in an attempt to smooth and reinforce frequency response but again there can be other consequences including a preferred listening sweet spot. The unique construction of the acoustic systems of the present disclosure provides accurate, life-like transmission of the musical information without the use of a whizzer cone or phase plugs and across a broad range of listening positions.

The foregoing description has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims set forth below.

I claim:

1. An acoustic system for accurately reproducing sound, comprising:

a driver including an actuator and a diaphragm wherein the actuator oscillates the diaphragm to produce a plurality of bidirectional pressure waves having a range of amplitudes and a range of higher and lower frequencies, wherein said driver is selected from the group consisting of 8 cm class, 3 inch class and 3.3 inch class drivers;

an enclosure supporting said driver and having an inner opening such that some of the pressure waves produced by the driver are directed through the enclosure and out of the inner opening, the inner opening having a select cross-sectional area of greater than 0.65 to about 1.3 times the cross-sectional area of the region defined by the outer periphery of the diaphragm such that the pressure of the pressure waves having lower frequencies is preserved; and a passage extending from the inner opening of the enclosure and terminating at an outer opening such that the pressure waves having lower frequencies are directed from the inner opening, through the passage, and out of the outer opening, the outer opening defining a cross-sectional area of about 8 to about 12 times the cross-sectional area of the inner opening such that the amplitudes of the pressure waves corresponding to the lower frequencies are amplified, said passage continuously increasing in cross-sectional area and spanning from about 1.5 meters to about 2.8 meters in length.

2. The acoustic system of claim 1, wherein the outer opening defines a cross-sectional area of about 8 to about 12 times the cross-sectional area of the region defined by the outer periphery of the diaphragm.

3. The acoustic system of claim 1, wherein the cross sectional area of the outer opening is about 10 times the cross-sectional area of the inner opening.

4. The acoustic system of claim 2, wherein the cross-sectional area of the outer opening is about 10 times the cross sectional area of the region defined by the outer periphery of the diaphragm.

5. The acoustic system of claim 1, wherein the passage spans about 2.2 meters to about 2.5 meters in length.

6. The acoustic system of claim 1, wherein the driver is a low-excursion type driver.

7. The acoustic system of claim 1, wherein the diameter of the region defined by the outer periphery of the diaphragm is about 5 cm to about 6 cm.

8. The acoustic system of claim 7, wherein said diameter is about 5 cm.

9. The acoustic system of claim 1, wherein the cross-sectional area of said passage increases in a generally exponential manner.

10. The acoustic system of claim 1, wherein the cross-sectional area of said passage increases in a generally conical manner.

11. The acoustic system of claim 1, wherein the passage includes a plurality of turns.

12. The acoustic system of claim 1, wherein the passage is split into sections.

13. The acoustic system of claim 1, further comprising a base for supporting the passage and wherein the outer opening is situated generally perpendicular to the base, such that the pressure waves are directed generally perpendicular to the base.

14. The acoustic system of claim 1, wherein a housing defines the enclosure and passage.

15. The acoustic system of claim 1, wherein the enclosure defines a volume of less than the Vas specification volume of said driver.

16. The acoustic system of claim 1, where the enclosure defines a volume of less than 1 liter.

* * * * *